US007765975B2

(12) United States Patent
Koriyama

(10) Patent No.: US 7,765,975 B2
(45) Date of Patent: Aug. 3, 2010

(54) ENGINE CYLINDER BLOCK

(75) Inventor: Masao Koriyama, Mori-machi (JP)

(73) Assignee: Owreik Petroliam National Berhad (MY)

( * ) Notice: Subject to any disclaimer, the term of this patent is extended or adjusted under 35 U.S.C. 154(b) by 159 days.

(21) Appl. No.: 10/708,560

(22) Filed: Mar. 11, 2004

(65) Prior Publication Data

US 2005/0199194 A1 Sep. 15, 2005

(51) Int. Cl.
*F02F 3/00* (2006.01)
*F02F 3/16* (2006.01)

(52) U.S. Cl. ..... 123/193.1; 123/41.44

(58) Field of Classification Search ..... 123/41.44, 123/193.1–193.5, 195 R, 195 H, 198 C
See application file for complete search history.

(56) References Cited

U.S. PATENT DOCUMENTS 4,237,847 A * 12/1980 Baugh et al. ..... 123/195 R
5,083,537 A * 1/1992 Onofrio et al. ..... 123/195 R
5,226,787 A * 7/1993 Freeman ..... 415/168.2
6,530,356 B2 * 3/2003 Inoue et al. ..... 123/196 R
6,863,035 B2 * 3/2005 Komorowski ..... 123/41.44

FOREIGN PATENT DOCUMENTS

JP 2001-65354(A) 3/2001

* cited by examiner

*Primary Examiner*—Mahmoud Gimie

(57) ABSTRACT

An engine cylinder block formed with an integral pump housing that reinforces the cylinder block and which has a communicating passage with the interior of the cylinder block that has an outer surface that is inclined upwardly of the cylinder block to permit gasses to escape during a casting process to avoid metallic voids from forming. In addition the block is further reinforced by longitudinal and vertical external ribs.

4 Claims, 9 Drawing Sheets

ENGINE CYLINDER BLOCK

BACKGROUND OF INVENTION

This invention relates to a cylinder block for an internal combustion engine and more particularly to an improved, cylinder block casting having an integral pump cavity formed therein.

Frequently engine cylinder blocks are formed by a casting process and include one or more integrally formed pumping cavities that contain pumping elements for circulating a liquid necessary for the engine operation such as for a coolant pump. A typical arrangement of this type is shown in Japanese Published Application JP-A-2001-65354. As seen in this publication, the cylinder block has a cylinder block body having a plurality of cylinder bores formed along the axial length thereof that are surrounded by cooling jackets. The casing of a cooling pump for delivering coolant projects outwardly from a side of the cylinder block. By forming the pump body integrally with the cylinder block the construction in made simpler and as an added benefit, the cylinder block is strengthened as the integral pump adds to its rigidity.

However with the prior art structures of this type another problem arises. That is when the pump casing is formed integrally with the cylinder block body the horizontally extending passage communicating the pumping cavity with the communicating cylinder block cavity can form a trap that blocks the free passage of the molten metal during the casting process and voids can develop that may be difficult to detect. In any event, these voids can result in scrappage that adds to the cost.

It is therefore a principle object of the invention to provide a effective and sound casting for a cylinder block that incorporates an integral pump.

It is a further object of the invention to provide an integral cylinder block and pump having high rigidity.

SUMMARY OF INVENTION

This invention is adapted to be embodied in a cylinder block for an internal combustion engine having a lower, crankcase receiving portion and an upper, cylinder head receiving portion. At least one cylinder bore is formed in the cylinder block extending between its lower and upper portions and surrounded at least in part by a coolant jacket. A pump receiving portion is formed at one side of the cylinder block and has a communication passage communicating with a corresponding passage formed in the cylinder block. In accordance with the invention, the communication passage has an upper wall that in inclined upwardly from the pump receiving portion toward the upper portion of the cylinder block to facilitate casting of the cylinder block without the formation of unwanted metal voids.

DETAILED DESCRIPTION

Figure 1:
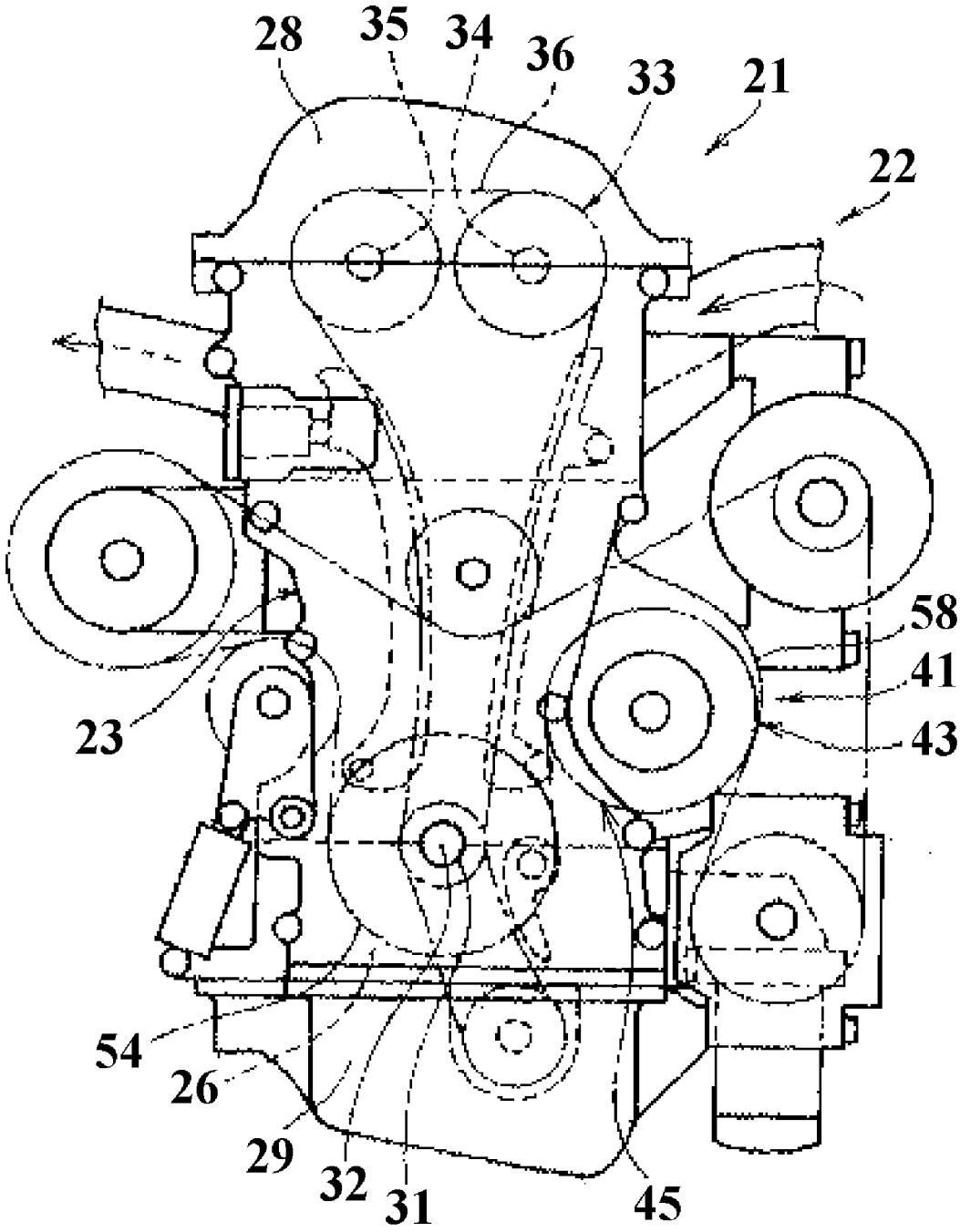
FIG. 1 is a front elevational view of an internal combustion engine embodying a cylinder block in accordance with the invention.
Figure 2:
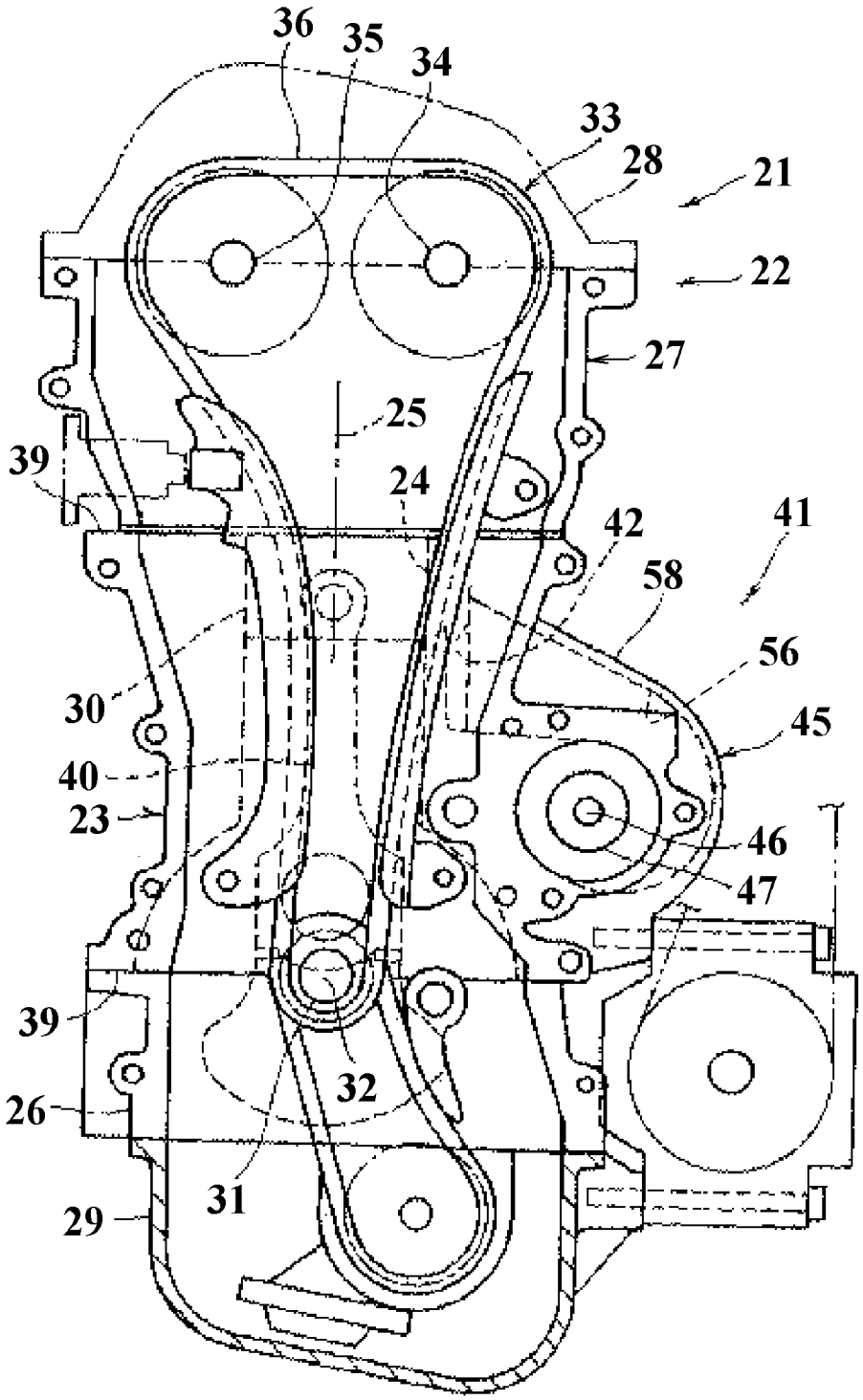
FIG. 2 is a front elevational view, in part similar to FIG. 1, but with the engine timing cover removed.
Figure 3:
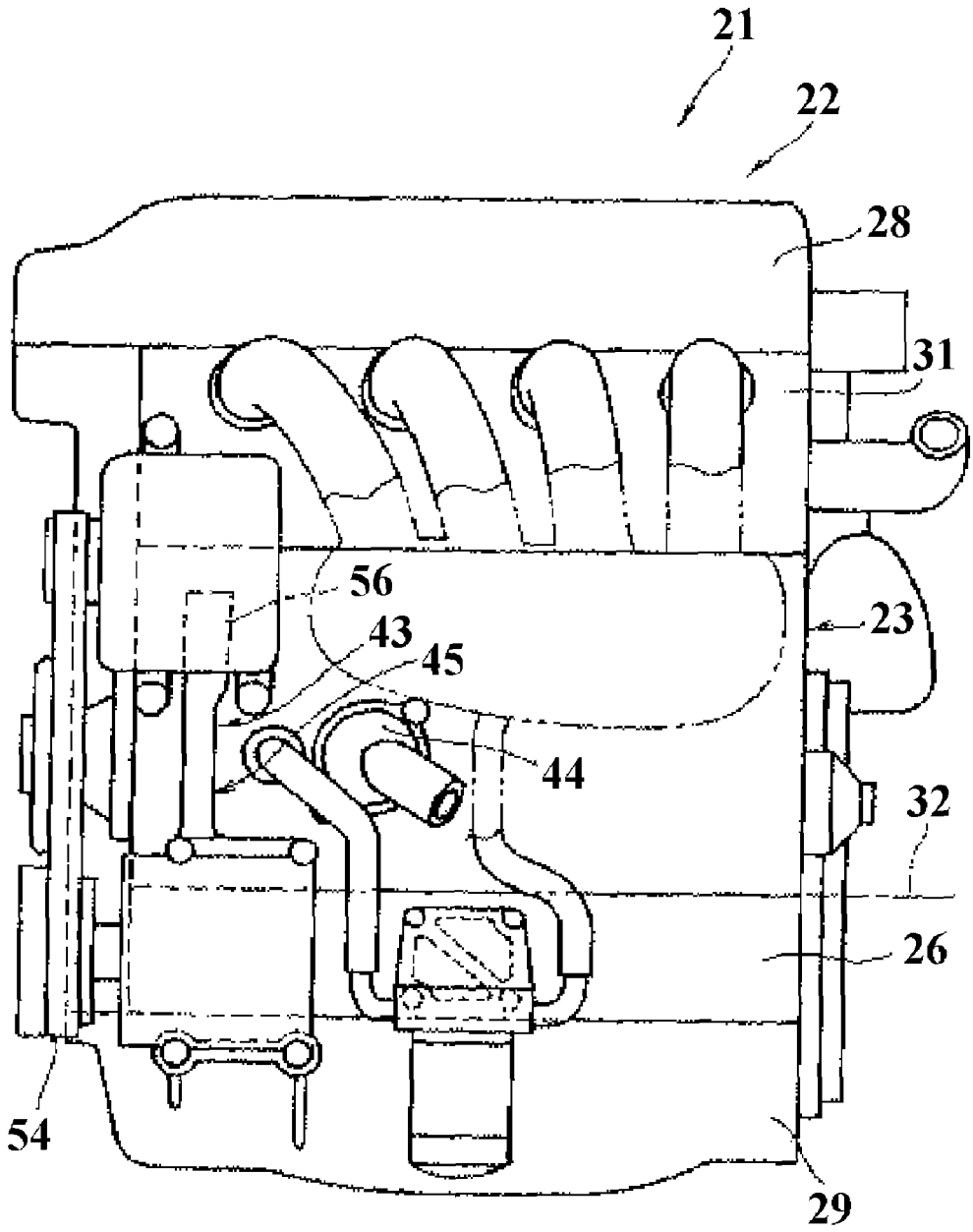
FIG. 3 is a side elevational view of the engine.

Referring now in detail to the drawings and initially primarily to FIGS. 1-3, a multi-cylinder, four-stroke internal combustion engine embodying the invention is indicated generally by the reference numeral 11. In the illustrated embodiment the engine 21 is shown as having four in line cylinders. Of course, from the following description it will be obvious to those skilled in the art, that the invention can be utilized with engines having other numbers of cylinders and other engine configurations. In addition the invention is not limited to engines operating on the four stroke principle.

The engine 21 is adapted to be mounted on and power a vehicle such as an automobile and is depicted as being mounted vertically therein, although the invention is not so limited. The engine 21 has an engine body, indicated generally at 22 supported in a suitable fashion by a vehicle body (not shown).

The engine body 22 is comprised of a cylinder block, indicated generally at 23, and cast in a manner to be described. The cylinder block 23 is formed with four cylinder bores 24 having parallel axes 25. Detachably affixed, in a known manner, to the lower end of the cylinder block 23 is a bulkhead 26 to form the upper portion of a crankcase.

A cylinder head assembly 27 is secured to the upper face of the cylinder block 23 in a known manner and closed the upper ends of the cylinder bores 24. The cylinder head assembly 27 supports valves for controlling the admission of a charge into the engine combustion chambers and the discharge of exhaust gasses therefrom in any suitable manner and as is well known in this art. These valves are operated in a manner to be described. This valve and operating mechanism is enclosed by a cylinder head cover 28 that is secured to the upper face of the cylinder head 27.

The aforedescribed crankcase, the upper portion of which is formed by the bulkhead 26 is completed and closed by an oil pan 29 that is suitably secured to the lower face of the bulkhead 26 and contains lubricating oil.

The engine 21 is provided with pistons 30 reciprocating in the cylinder bores 24 and connected by connecting rods 40 to drive a crankshaft 31. The crankshaft 31 rotates about an axis 32 that extends generally horizontally. The crankshaft 31 is journalled about this axis 32 by bearings carried by the cylinder block 23 and bulkhead 26 in a manner well known in the art.

The aforedescribed intake and exhaust valves are operated in a suitable manner by a valve actuating mechanism, indicated generally at 33. This valve actuating mechanism 33 is comprised of an intake camshaft 34 and an exhaust camshaft 35 in suitable operational engagement with the intake valves and exhaust valves, respectively. The camshafts 34, 35 haves axes that extend parallel to the axis 32 of the crankshaft 31. A timing chain 36 for interconnects one end of the crankshaft 31 with the ends of the camshafts 34, 35 to drive them in timed relation at one half the rotational speed thereof.

As has been noted, the cylinder block 23 is made by casting, and preferably of low pressure cast aluminum. The cylinder block generally comprises a cylinder block body, indicated generally at 37, comprised primarily of a body portion 38 having a generally cubic shape and in which the plurality of cylinder bores 24 are formed. The body portion 38 also has upper and lower faces 39. The upper face 39 is in suitable sealing contact with the lower face of the cylinder head 27. In a like manner, the lower face 39 is in suitable sealing contact with the upper face of the bulkhead 26.

The engine 21 is provided with a cooling system, indicated generally at 41, for cooling the engine body 22 with a suitable coolant. The cooling system 41 is comprised of with coolant jackets 42 formed around the cylinder bores 24 in the cylinder block body 37. In addition the cooling system 41 includes a coolant pump, indicated generally by the reference numeral 43, supported on the lateral face of the cylinder block body 37 and capable of delivering the coolant to the coolant jackets 42. The cooling system also includes a pump drive, to be described shortly, a radiator (not shown) for cooling the coolant after having been delivered to the coolant jackets 42 and a thermostat 44 (FIG. 3) for controlling the temperature of the coolant.

Figure 6:
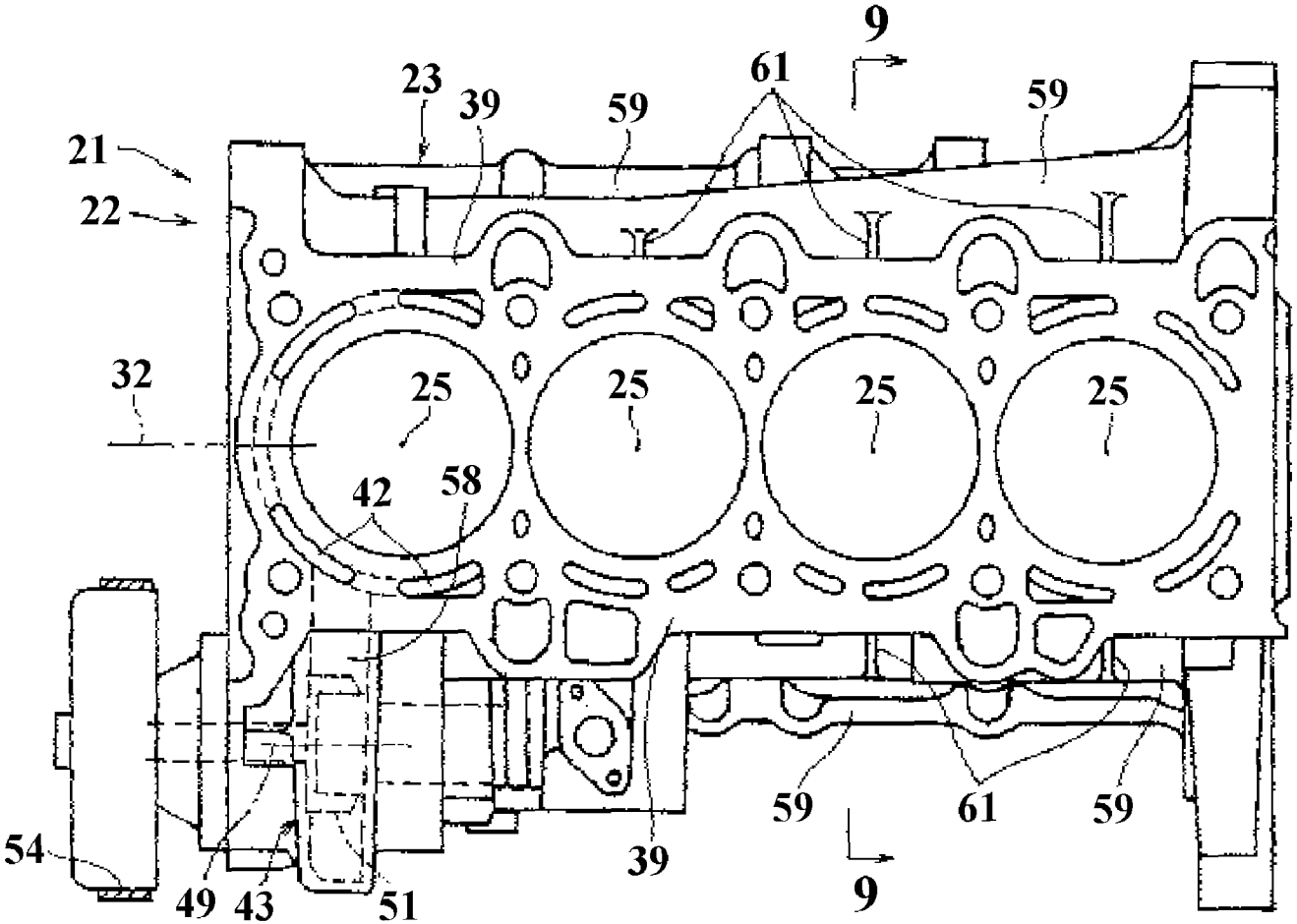
FIG. 6 is a top plan view of the cylinder block with the fully assembled coolant pump and its drive.
Figure 7:
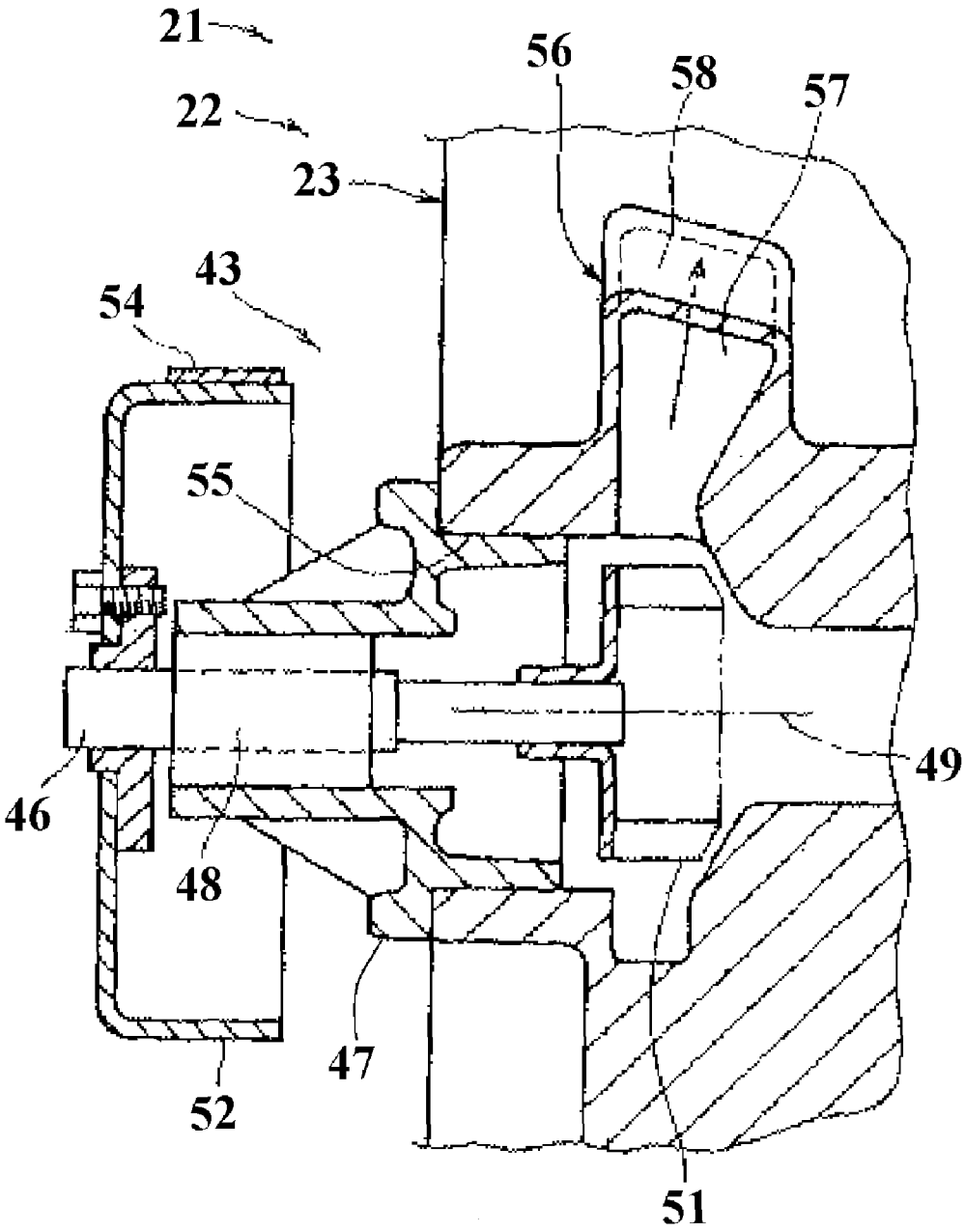
FIG. 7 is a cross sectional view taken through the rotational axis of the coolant pump.
Figure 8:
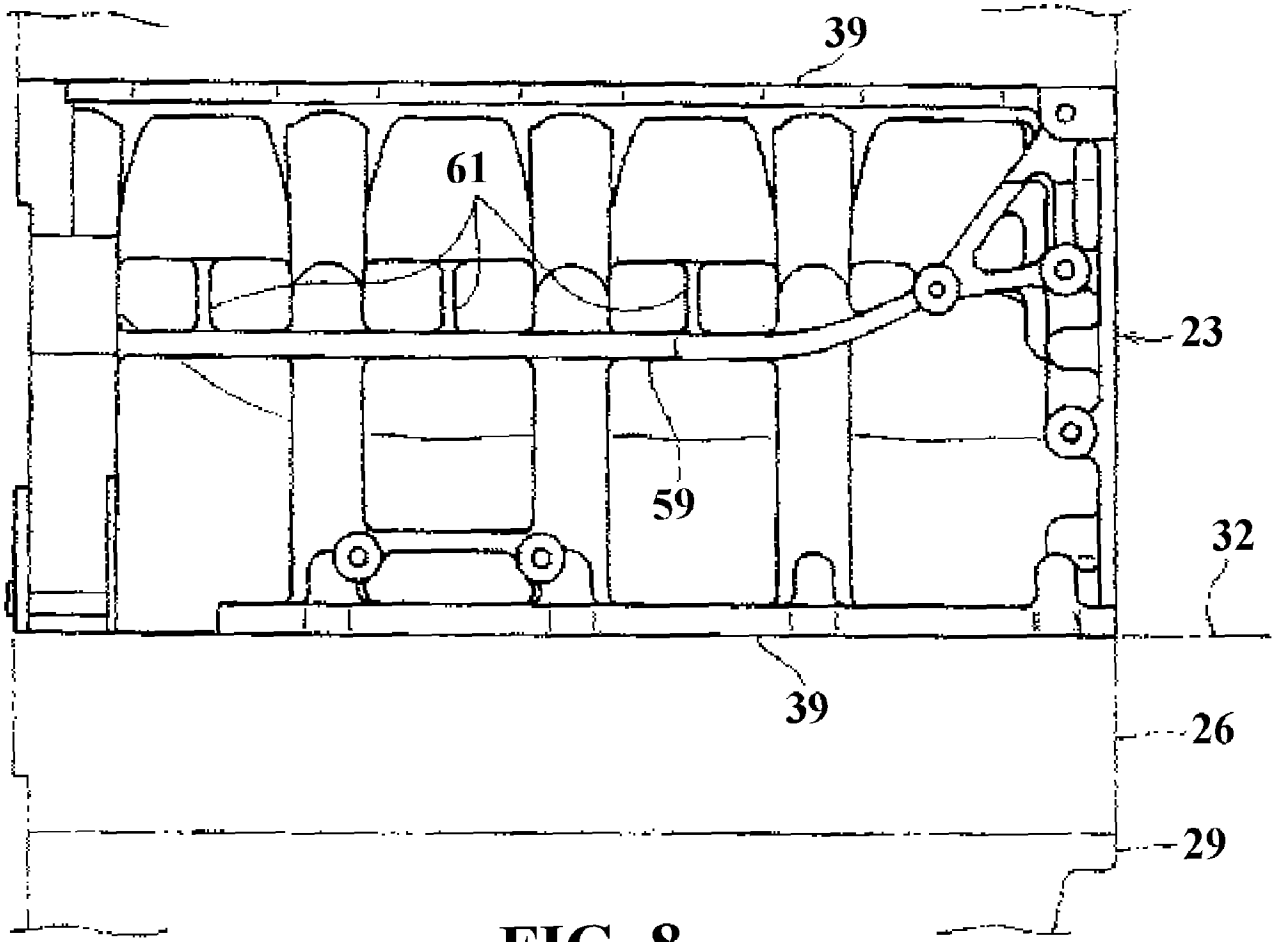
FIG. 8 is a side elevational view, in part similar to FIG. 5, but showing the opposite side of the cylinder block.

As shown in FIGS. 1-4, 6 and 7, the coolant pump 43 is provided with an outer casing, indicated generally at 45 formed in part integrally with and supported by the cylinder block body 37. As best seen in FIGS. 6 and 7, a pump drive shaft 46 is supported by a closure 47 of the casing 45 via a bearing 48 for rotation about an axis 49 extending in parallel with the axis 32 of the crankshaft 31. An impeller 51 is disposed in a pump chamber in the casing 45 and supported for rotation about the axis 49 on an end of the pump drive shaft 46.

As seen in FIG. 7, the pump casing 45 integrally protrudes forwardly from the outer lateral face at one end of the body portion 38 of the cylinder block body 37. Thus the pump casing 45 is also made of low pressure cast aluminum.

As seen in FIGS. 1 and 7, the pump shaft 46 and impeller 51 are provided with a pulley 52 that is driven from a pulley 53 fixed to the outer end the crankshaft 31 by a V-belt 54. This belt 54 also may drive further engine or vehicle auxiliaries.

Figure 4:
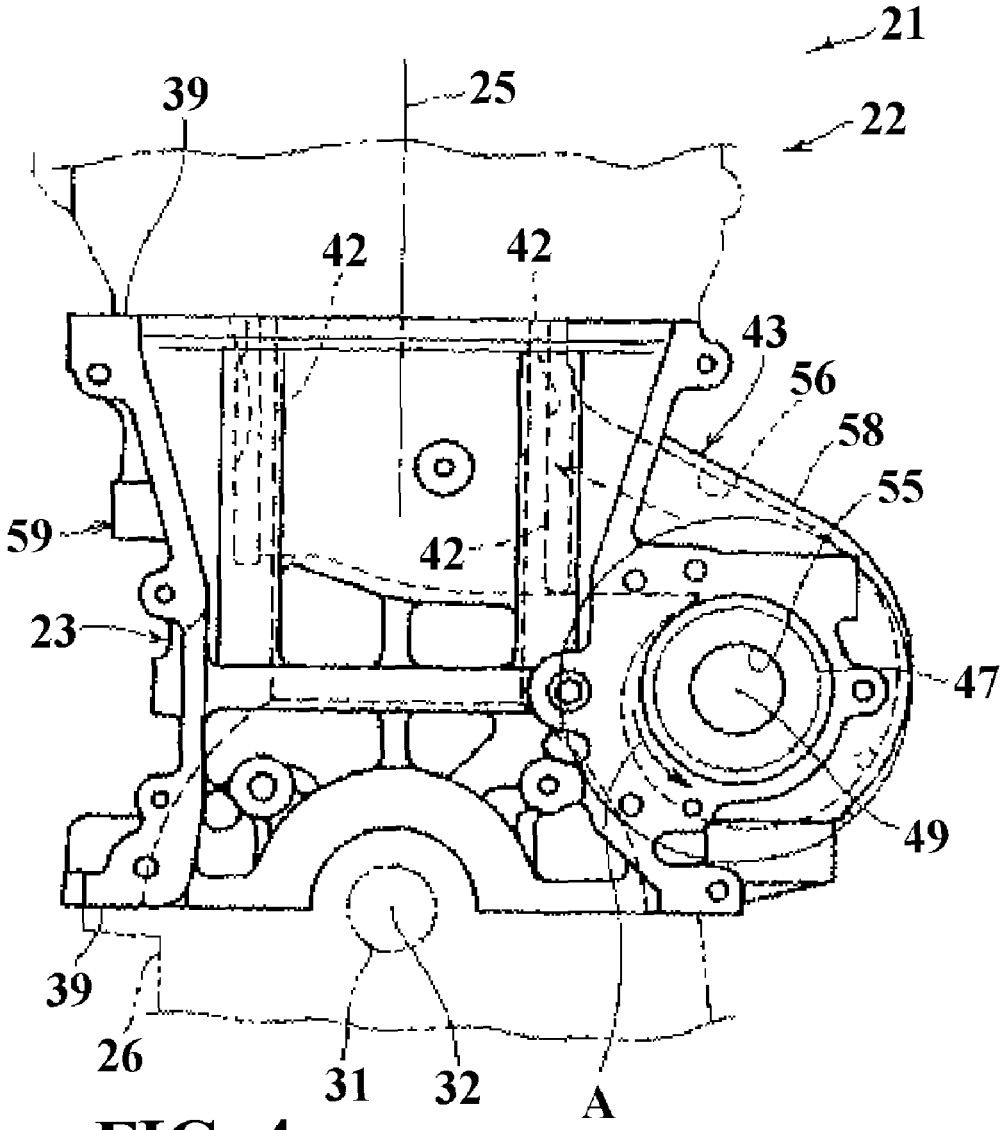
FIG. 4 is a front elevational view, in part similar to FIGS. 1 and 2, but shows only the cylinder block in solid lines with the cylinder head and bulkhead being shown in phantom for reference.
Figure 5:
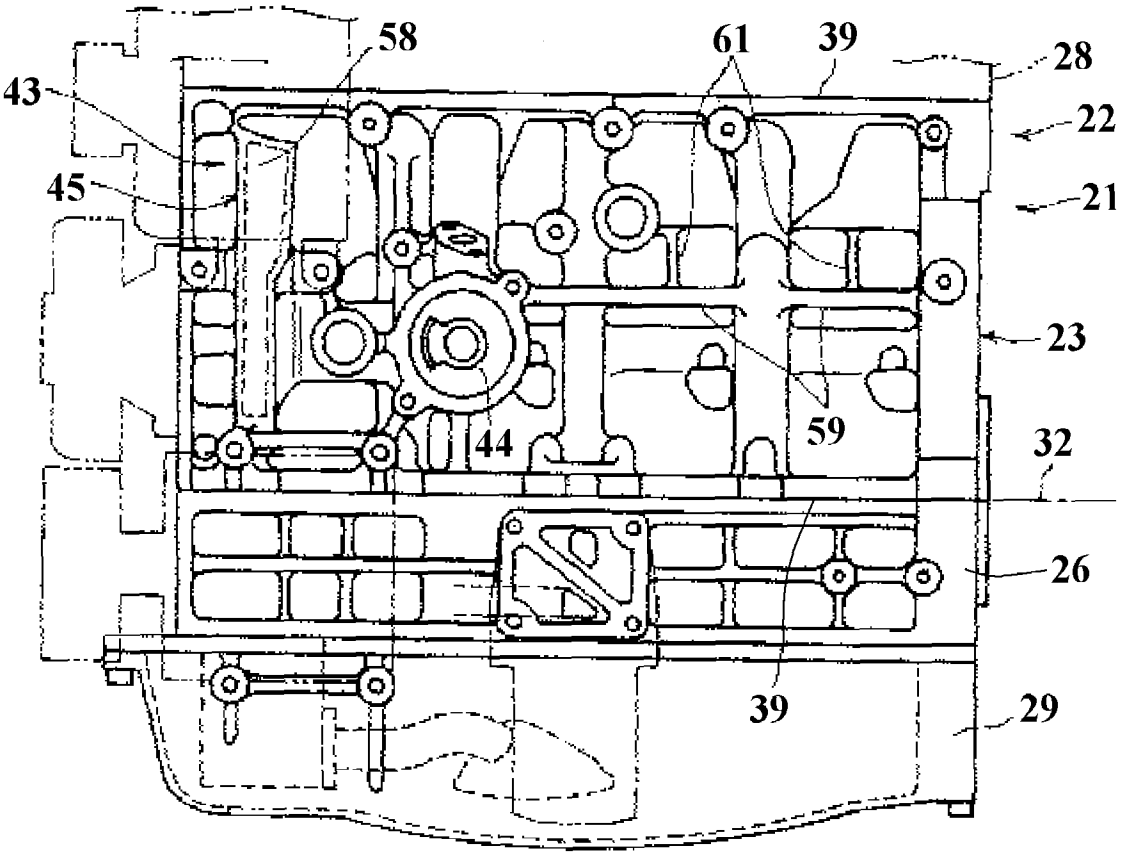
FIG. 5 is a side elevational view, in part similar to FIG. 3, but shows only the cylinder block in solid lines with the remainder of the engine being shown in phantom for reference.

As shown in FIGS. 4, 6 and 7, the casing 45 defines the pump chamber, which is in a spiral shape as viewed along the axis 32 of the crankshaft 31 and the axis 49 of the pump drive shaft 46. As already noted, the pump drive shaft 46 is journalled on the bearing 48 carried by the closure 47. This closure 47 is received in a circular insertion opening 55 formed in the front face of the casing 45 coaxially with the axis 49. The insertion opening 55 allows insertion of the impeller 51 in the direction of the axis 49. The inner side of the front face of the pump casing 45 is in the form of a spiral, in which the distance to the axis 49 of the impeller 51 gradually increases in a counterclockwise direction. Thus, the radial distance from the inner surface of the outer to the opening edge of the insertion opening 55 becomes increasingly greater in this direction.

As best seen in FIG. 7, the casing 45 is provided with a discharge duct 56 with a closed rectangular cross section integrally protruding from the upper part of the casing body 45 toward the cylinder block body 37. The protruding end of the discharge duct 56 is integrally joined to the lateral face of the cylinder block body 37. The upper part of the pump chamber containing the impeller 51, an internal passage 57 formed in the discharge duct 56, and the coolant jackets 42 thus communicate with each other. The internal passage 57 of the discharge duct 56 has a cross section which gradually increases toward the cylinder block body 37. The discharge duct 56 has an upper surface 58 forming the upper part of the casing 45 that is inclined upward from the protruding end of the casing 45 toward the cylinder block body 37. The outer lateral face of the cylinder block body 37 and the casing 45 are integrally joined to each other over almost the entire contact area in the vertical direction of the cylinder block body 37, whereby the cylinder block body 37 is significantly reinforced.

Figure 9:
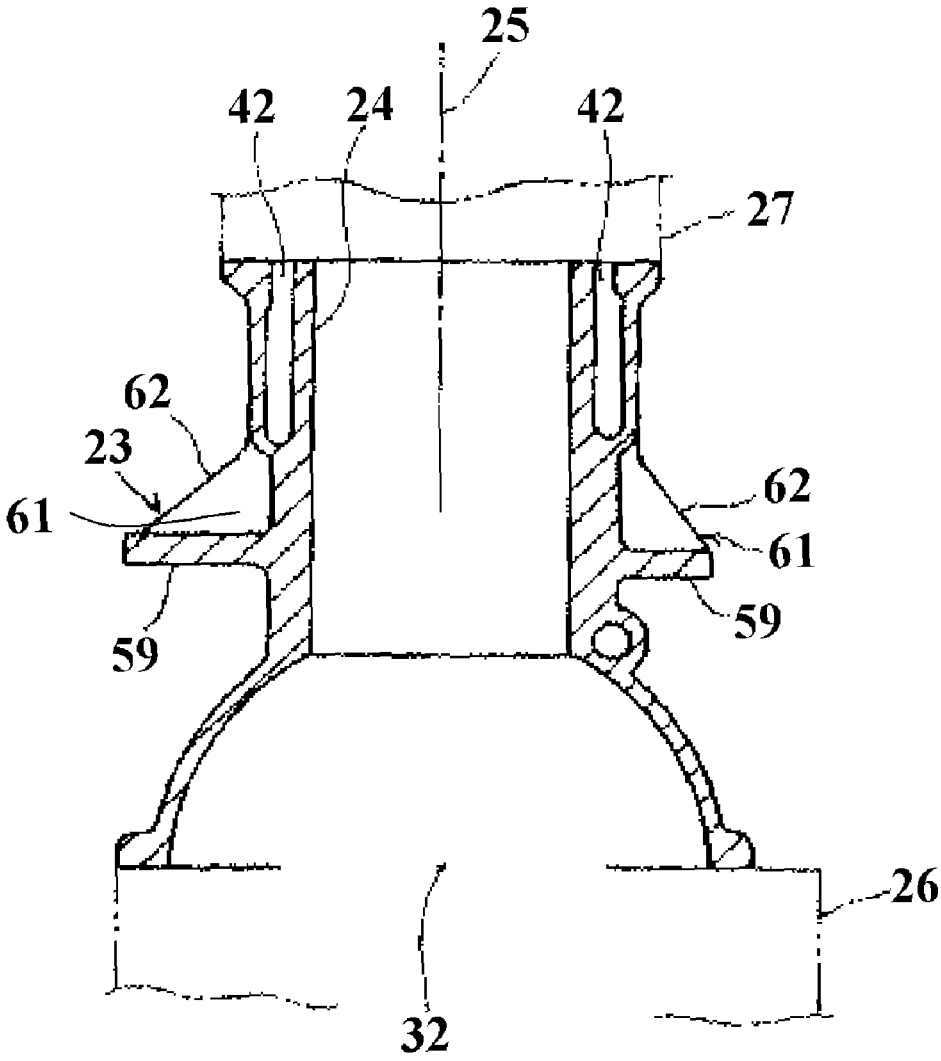
FIG. 9 is a cross sectional of the cylinder block taken along the line 9-9 in FIG. 6 with the bulkhead and cylinder head being shown partially and in phantom for reference.

In addition to the reinforcing of the cylinder block 23 by the integration of the coolant pump outer casing 45 and as shown in FIGS. 5, 6, 8 and 9, the engine body 22 is provided with integral, horizontal reinforcing ribs 59 that protrude outward from opposite sides of the cylinder block body 37 at approximately the vertical midsection. These horizontal ribs 59 are joined by integral vertical reinforcing ribs 61 located generally in the same axial positions as the axes 25 of the cylinder bores 24 and formed integrally with the upper outer lateral face of the cylinder block body 37 and the upper faces of the horizontal ribs 59. As best seen in FIG. 9, the vertical ribs 61 taper as indicated at 62 inwardly in the vertical direction so as to assume a right-angled triangle shape when as viewed in the direction of the axis 32 of the crankshaft 31.

Because of the described configuration, when producing the cylinder block 23 by low pressure casting, as molten metal fills up the space corresponding to the coolant pump casing 45 within a mold formed by an outer frame and a sand core in a shape corresponding to the cylinder block 23, the gas in the space corresponding to the upper part of the casing 45 is smoothly directed to the space corresponding to the cylinder block body 37 since the upper surface 58 of the casing 45 is inclined upward toward the cylinder block body 37. Thus the molten metal is prevented from being trapped in the space corresponding to the upper part of the casing 45 and thus producing voids. Thus, it is possible to t produce a high-quality cylinder block 23. Also since the upper surface 58 of the coolant pump casing 45 is inclined upward toward the cylinder block body 37, the coupling area between the cylinder block body 37 and the coolant pump casing 45 in the vertical direction is enlarged as compared with when the upper surface 58 extends horizontally toward the cylinder block body 37. Thus, the cylinder block body 37 is reinforced by the casing 45 for the coolant pump 43 effectively, and the strength of the cylinder block 23 is increased.

The rigidity of the cylinder block 23 is further increased by the horizontal ribs 59 integrally protruding outward from the vertical midsection of the outer lateral face of the cylinder block body 37, and the vertical ribs 61 located generally in the same positions as the axes 25 of the cylinder bores 24 in the axial direction of the crankshaft 31 Thus the portions of the cylinder block body 37 which tend to have lower strength because of the cylinder bores 24, among the portions other than the portion with which the casing 45 is formed integrally, are reinforced by the horizontal ribs 59 and, in particular, the vertical ribs 61. Thus, the strength of the cylinder block 23 can be reasonably improved so that every part of it can have uniform strength.

Of course those skilled in the art will readily understand that the described embodiments are only exemplary of forms that the invention may take and that various changes and modifications may be made without departing from the spirit and scope of the invention, as defined by the appended claims. For examples only, the engine 21 may be a two-stroke engine and/or the axes 25 of the cylinder bores 24 may be inclined with respect to the vertical. Also the discharge duct 56 may have a circular cross section.

The invention claimed is:

1. A cylinder block for an internal combustion engine having a lower, crankcase receiving portion and an upper, cylinder head receiving portion, a plurality of axially spaced cylinder bores formed therein extending between said lower and upper portions and surrounded at least in part by a coolant jacket, and a pump receiving portion formed at one side of said cylinder block and having a communication passage communicating with said cooling jacket formed in said cylinder block, said communication passage having an upper wall that is inclined upwardly relative to said cylinder bore from said pump receiving portion toward the upper portion of said cylinder block to facilitate casting of said cylinder block without the formation of unwanted metal voids and a plurality of reinforcing ribs formed on opposite sides of said cylinder block each of which is aligned with the axis of a respective one of said cylinder bores.

2. A cylinder block as set forth in claim 1, further including a pair of axially extending reinforcing ribs each extending transversely outwardly from a central portion of a respective side of the cylinder block.

3. A cylinder block as set forth in claim 2, wherein the communication passage terminates in the cylinder block at the upper end thereof.

4. A cylinder block as set forth in claim 3, wherein the pump comprises an engine coolant pump and the communication passage communicates with the cooling jacket.

* * * * *